United States Patent [19]

Kwang

[11] Patent Number: 4,905,284

[45] Date of Patent: Feb. 27, 1990

[54] AUDIO SYSTEM FOR VEHICULAR APPLICATIONS

[75] Inventor: David Kwang, Pasadena, Calif.

[73] Assignee: Concept Enterprises, Inc., Vernon, Calif.

[21] Appl. No.: 314,509

[22] Filed: Feb. 21, 1989

[51] Int. Cl.[4] ..... H04S 3/00

[52] U.S. Cl. ..... 381/27; 381/100

[58] Field of Search ..... 381/99, 27, 100, 28, 381/123

[56] References Cited

U.S. PATENT DOCUMENTS

| | | | |
|---|---|---|---|
| 3,016,424 | 1/1962 | Franke | 381/99 |
| 3,417,203 | 12/1968 | Hafler | 381/27 |
| 3,657,480 | 4/1972 | Cheng et al. . | |
| 4,293,821 | 10/1981 | Boudouris et al. | 330/126 |
| 4,329,544 | 5/1982 | Yamada . | |
| 4,408,095 | 10/1983 | Ariga et al. | 381/27 |
| 4,429,181 | 1/1984 | Freadman | 381/99 |
| 4,622,691 | 11/1986 | Tokumo et al. | 381/86 |
| 4,648,117 | 3/1987 | Kunugi et al. | 381/86 |
| 4,759,065 | 7/1988 | Field et al. | 381/98 |
| 4,771,466 | 9/1988 | Modafferi | 381/99 |

*Primary Examiner*—Forester W. Isen

*Attorney, Agent, or Firm*—Merchant, Gould, Smith, Edell, Welter & Schmidt

[57] ABSTRACT

Electronic crossover modules and systems in accordance with the invention employ a set of crossover channels in each module together with internal input interconnections which enable input signals to be serially intercoupled but cutoff points to be separately adjustable. Each module comprises two independently settable, variably interconnectable high pass channels and a third low pass channel which also is independently settable, and which can receive signals from the first two channels and/or a different module and also transmit signals to a different module. Using the available input interconnections and a frequency multiplier control in the first channel, great versatility in bi-amp and tri-amp with two channel and/or four channel operation is achieved.

16 Claims, 7 Drawing Sheets

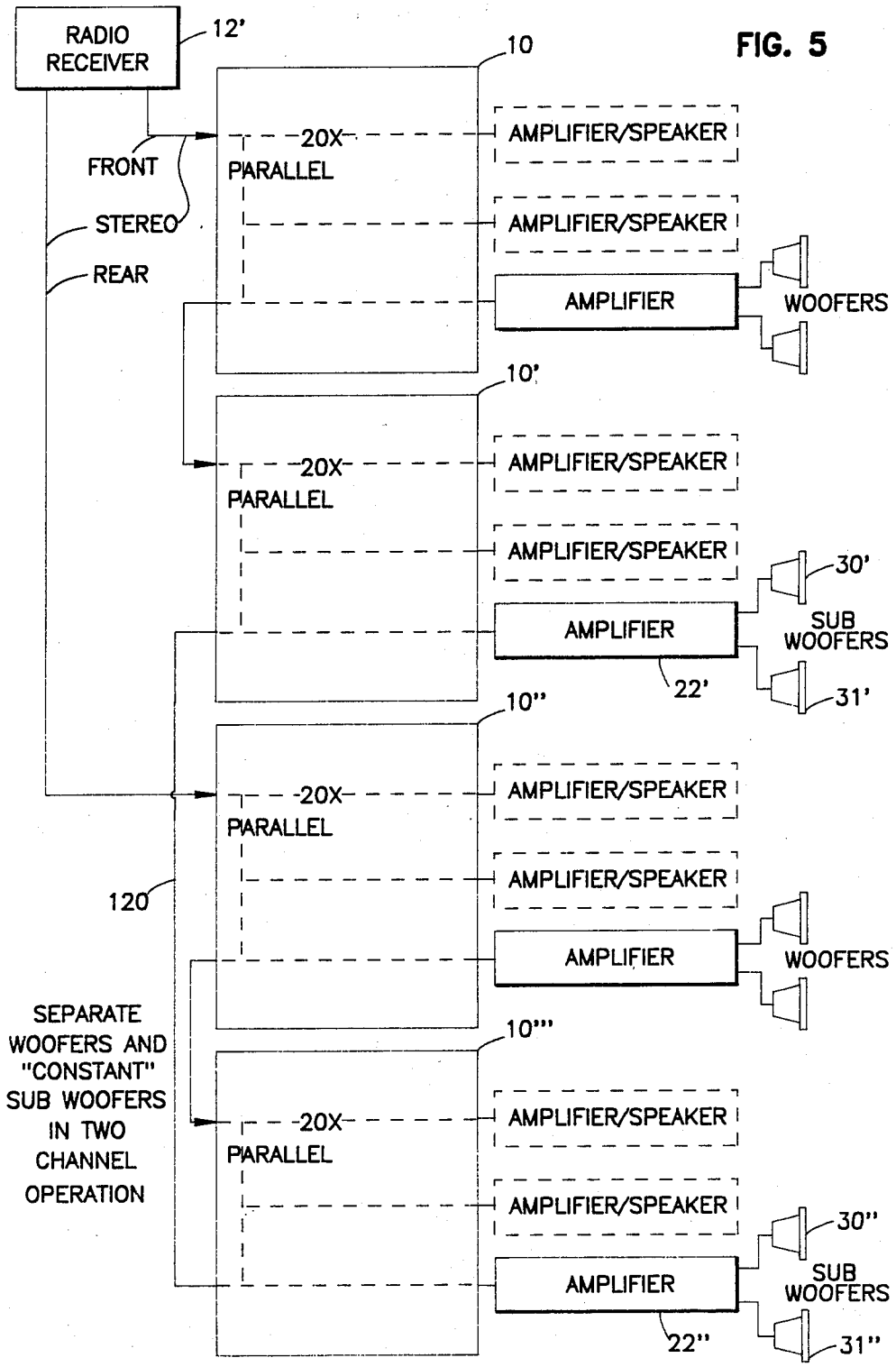
RADIO RECEIVER
12'
10
FIG. 5
FRONT
STEREO
REAR
20X
PARALLEL
AMPLIFIER/SPEAKER
AMPLIFIER/SPEAKER
AMPLIFIER
WOOFERS
10'
20X
PARALLEL
AMPLIFIER/SPEAKER
AMPLIFIER/SPEAKER
30'
AMPLIFIER
SUB WOOFERS
22'
31'
10''
20X
PARALLEL
AMPLIFIER/SPEAKER
AMPLIFIER/SPEAKER
120
AMPLIFIER
WOOFERS
SEPARATE WOOFERS AND "CONSTANT" SUB WOOFERS IN TWO CHANNEL OPERATION
10'''
20X
PARALLEL
AMPLIFIER/SPEAKER
AMPLIFIER/SPEAKER
30''
AMPLIFIER
SUB WOOFERS
22''
31''

AUDIO SYSTEM FOR VEHICULAR APPLICATIONS

BACKGROUND OF THE INVENTION

This invention relates to high performance audio systems, and more particularly to multi-amplifier audio systems for vehicular installations.

Car stereo systems face unique problems in high fidelity reproduction of recorded or broadcast sound, because speaker placement, speaker types, amplifier power, crossover networks, limited internal space, internal vehicle geometry, and other factors can all affect the quality and characteristics of the sound which the listener hears. Increasing amplifier power, despite the consequent expense, does not confront the major problems, which derive both from the limited space available for installations and the complex nature of internal reflections within a vehicle. Acoustic waves launched from a given speaker location into the interior of a vehicle are reflected within relatively short distances off interior surfaces. They then will often reflect back and forth between opposed surfaces to establish standing waves, thus creating resonance peaks within the audible frequency spectrum. Because the interior dimensions of a vehicle are limited, resonances arise in the longer wave (low frequency) region of approximately 60 Hz or less to 300 Hz or more. Moreover, such simple resonances are often accompanied by complex standing waves which are created because of multiple, oblique-angled reflections off different surfaces within the three-dimensional volume of the vehicle.

For many years car stereos were designed for the younger market, and these car stereo users and perhaps also the music they preferred in many instances created a demand for the "boomy" bass characteristic inherent in low frequency resonances. When greater discrimination began to be exercised, systems were augmented with graphic equalizers by which the frequency spectrum could be subdivided into multiple bands (typically from about 3 to 12 separate bands) and each could be adjusted in amplitude. This approach allows for some specific adjustments but has been predominantly used with single amplifier types of systems.

There has been an increasing recent trend toward improving the fidelity of car audio systems, as opposed to earlier tendencies to use excessive power at low frequency levels. An earlier stereo installation might have used two speakers, each comprising a mid-range and tweeter unit, spaced apart in the front or rear of the vehicle. These would be driven through a crossover network from a single amplifier. It is now common, however, to use "multi-amp" installations, in which speakers for the different frequency ranges are each driven by a separate amplifier. The value of cleaner low frequency ranges has become more apparent and separately driven woofers and sub-woofers are thus increasingly being used. The multi-amp installations include so-called "biamps", employing a two-way division of the frequency ranges, and "tri-amps" in which the division is between low frequency (woofer), mid-range unit and high frequency (tweeter). A subwoofer is often alternatively used for the lowest frequency range to enhance bass response, the sub-woofer unit often being monaural.

To achieve a substantially flat frequency response within a vehicle using a multi-amp system, the trend has been to use electronic crossovers. The electronic crossovers are adjustable as to crossover point, and operate more efficiently than do passive crossover networks. Because they are adjustable, a troublesome resonance or null in a given frequency range can be compensated by spacing crossover points so as to diminish response, or overlapping the crossover points so as to enhance response.

Known electronic crossover systems are limited in their capabilities, as presently implemented, because they are generally restricted to two separate independently adjustable frequency bands. It is recognized that they can be cascaded (used in series) to give tri-amp as well as bi-amp capability, but this limits the capability for adjustment because a later crossover can only choose a higher high-pass (or a lower lowpass) level for cutoff.

When a multi-amp system is installed in a vehicle, the number and placement of speakers, and the number and placement of the electronic circuits, are determined by the spaces available. The internal geometry of the vehicle can vary with car style, even in a particular model (e.g. two door vs. four door) and with the interior materials that are used. Thus if electronic crossovers are to be used to flatten frequency response, or shape frequency response to the preferences of the listener, a design having novel versatility is required. A high degree of pegmentation of the frequency band may be used in accordance with the performance of a specific combination of units in a particular vehicle. Additionally, it may be desired to revise an existing system, as by adding new components to convert from a bi-amp to a tri-amp system. Applications need not, of course, be limited to the conventional tweeter, mid-range, and woofer or sub-woofer configurations, inasmuch as it may be desirable for some installations to utilize a five-way or seven-way arrangement or even greater number of speakers, together with varying crossover points and different speakers ranging from super tweeters to sub-woofers.

SUMMARY OF THE INVENTION

An electronic crossover system in accordance with the invention comprises a three internal channel crossover model having an input and an output for each channel, and internal input switching and interconnection capability, together with independently controllable high pass crossover filters in two of the channels and an independently controllable low pass crossover filter in the third channel. Internal connections within the module selectively can couple the two high pass channels in parallel to receive a common input, or enable them to receive separate inputs. Both input signals are applied through a summing circuit to the input of the third channel, this summed signal also being coupled to an input/output port for the third channel, which further may be used to receive inputs at the same port that are isolated from the first and second channels. There is thus capability for serial intercoupling of different channels and modules, so that they can be chained together, with parallel input signals being independently adjusted. Front and rear channels can be kept separate or combined in different ways, and a constant sub-woofer output can be generated to eliminate fading even though front and rear signals are otherwise used independently.

The first of the high pass channels also includes means for alternatively using a separate high pass filter having a cutoff at a multiple (e.g. 20 times) of the nominal setting for that channel. Thus the second channel can have a different cutoff point for the same signal. The channels include preamplifiers and level adjustment controls, and the low pass channel preferably also includes a single octave 12 dB boost at 45 Hz and stereo-mono switch means that can be selectively activated for driving sub-woofer speaker equipment in either stereo or mono mode.

With these electronic crossover modules, multi-amp systems can be configured with great versatility to enable different vehicular components to be intercoupled and then adjusted for flat frequency response in accordance with the number and placement of speakers and the internal geometry and acoustic properties of the vehicle. For example, crossover modules can be chained together, but with the channels in parallel and not tandem, by coupling the mixed in/out terminal at the input of the third channel of one module to an input of another module. Thus, an initial tri-amp configuration can be supplemented by additional bi-amp configurations, to virtually any desired limit. The high pass inputs can be utilized in parallel with a single stereo signal, or if separate (e.g. front and rear) stereo signals are provided from a signal source, these inputs can be coupled separately to the two high pass channels. This enables four channel operation with independent front and rear adjustability, including crossover points. Furthermore, the selectively actuable multiplier feature for the high pass cutoff enables the first high pass channel to be used to drive tweeter loudspeakers, while the second high pass channel drives midrange loudspeakers. Because the electronic crossover means are independently adjustable they may be set asymmetrically at spaced apart or overlapping crossover points, to diminish resonances or peaks in the audible frequency spectrum. The third channel may be used to drive a woofer speaker, or a sub-woofer in accordance with the frequency setting. Moreover, since there may be a substantial delay in low frequency waves relative to higher frequency waves from differently placed tweeter and mid-range speakers, the third channel includes means for selectively switching the signal phase by 180° to compensate for the previously mentioned acoustical time delay.

With these arrangements and features, therefore, systems in accordance with the invention can couple a variety of signal sources to a wide range of differently placed speakers having separate amplifiers. Bi-amp systems can be converted to tri-amp, and vice versa, and additional speakers can be added into a system, with a range of crossover adjustments and amplitude level changes being available for each reconfiguration. An important aspect of the invention resides in the fact that a "constant" combined front/rear signal can be applied to the low pass channels of one or more modules.

BRIEF DESCRIPTION OF THE DRAWINGS

A better understanding of the invention may be had by reference to, the following description, taken in conjunction with the accompanying drawings, in which:

FIG. 5 is a block diagram representation of yet another audio installation in accordance with the invention.

DETAILED DESCRIPTION OF THE INVENTION

Figure 1A:
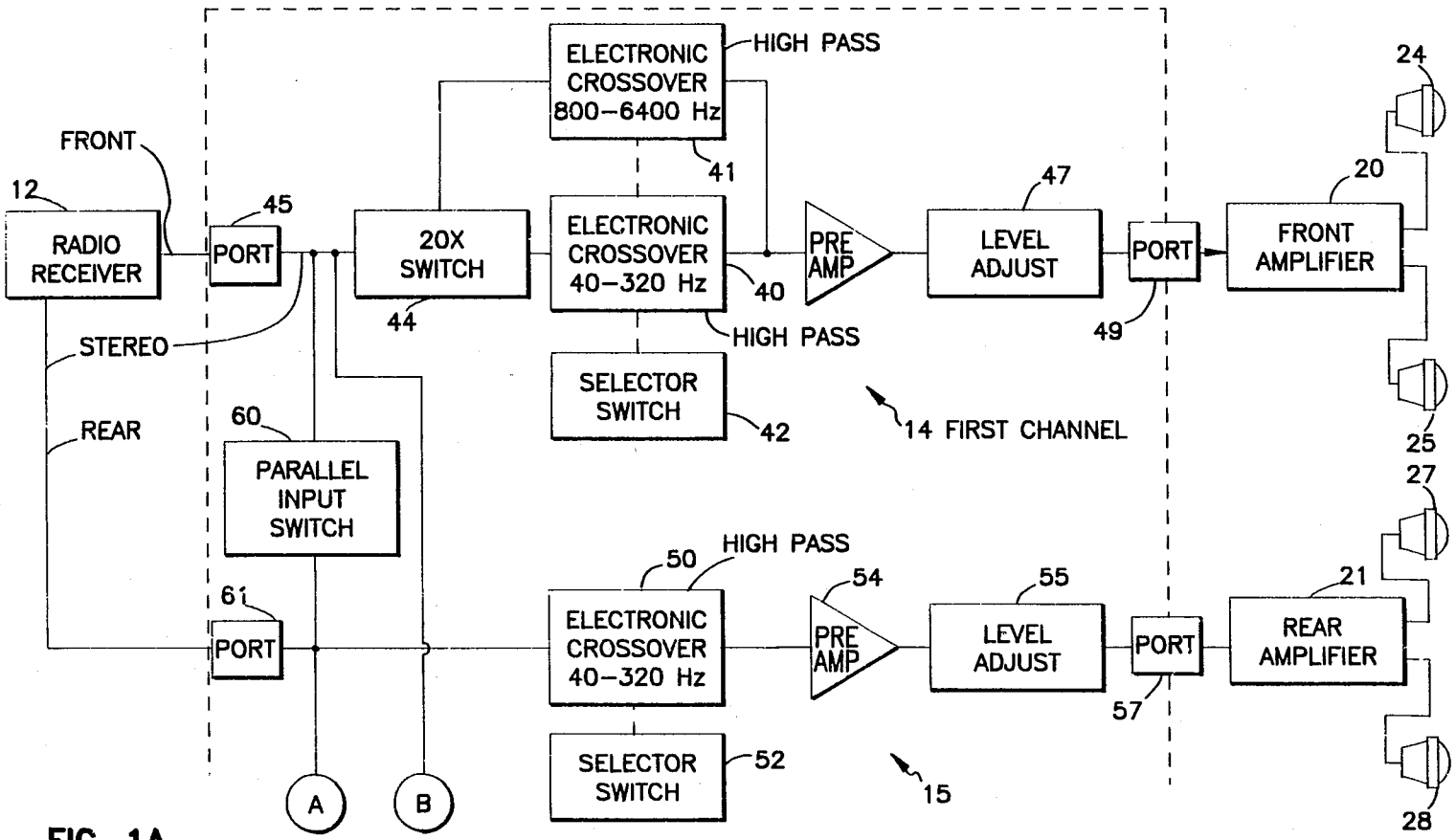
FIGS. 1*a* and 1*b* together form a block diagram of an electronic crossover and audio system in accordance with the invention for vehicle installation.
Figure 1B:
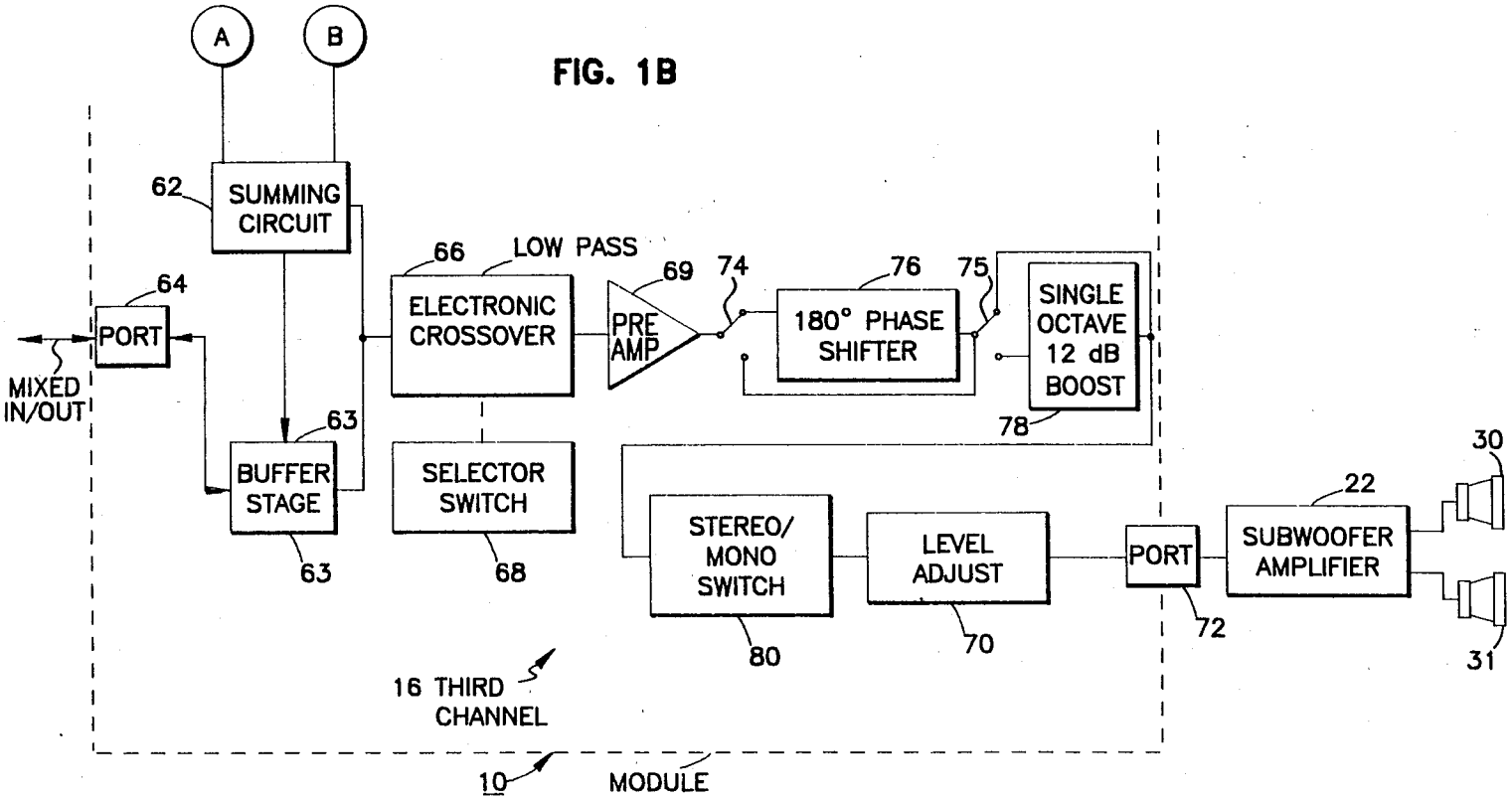

An electronic crossover module 10 is depicted, referring now to FIG. 1, as it is employed in a bi-amplifier configuration, receiving signals from a source 12, such as a radio receiver having separate front and rear outputs. In this configuration, separate first, second, and third channels 14, 15 and 16 respectively within the module 10 feed signals to a front amplifier 20, rear amplifier 21 and sub-woofer amplifier 22, each providing stereo outputs (assuming stereo inputs) to a different pair of associated speakers. The front amplifier 20 drives a pair of mid-range speakers 24, 25, while the rear amplifier 21 drives a like pair of mid-range speakers 27, 28 and the sub-woofer amplifier 22 drives a pair of large speakers 30, 31 with the summed front and rear channel signals.

Within the electronic crossover module 10, the first channel 14 has a pair of electronic high pass crossover circuits 40, 41 both controlled by a single selector switch 42 having incremental settings with markings at 40, 80, 160 and 320 Hz increments and intermediate settings inbetween. The first high pass crossover 40 is controllable within the 40–320 Hz range, but the second crossover 41 operates in a 20 times higher range, from 800–6400 Hz. Whichever high pass crossover circuit 40, 41 is used, it cuts off everything below the selected frequency level. The input signal is applied to a selected one of the high pass crossover circuits 40, 41 by shifting the position of a "20 X" switch 44 coupled into the input line after an input port 45 to which signals may be applied by an RCA-type connector. The output signals from both crossover circuits 40, 41 are applied through a pre-amp 46 and a level adjust circuit 47 to the front output port 49, which is coupled to provide inputs to the front amplifier 20.

The second channel has only a single high pass crossover 50 controlled by its own incrementally variable selector switch 52, to provide high pass cutoff in the range from 40 Hz to 320 Hz. Output signals from the crossover 50 are passed through a pre-amp 54 and a level adjust circuit 55 to a rear output port 57. A parallel input switch 60 between the input lines into the first channel 14 and the second channel 15 establishes internal parallelism between these inputs when the switch 60 is closed to complete the parallel path. In the parallel setting one input controls both channels, while in the alternate setting of the switch 52 separate inputs must be applied.

The inputs of both the first and second channels 14, 15 respectively are coupled to a summing circuit 62 in the third channel 16. The summing circuit is in turn coupled to a buffer stage 63 which can also combine inputs from the mixed in/out port 64 for the third channel. Thus, inputs to the input port 45 for the first channel and to the input port 61 for the second channel may be used to activate the third channel 16. This applies whether one or both of the front and rear inputs are active from the source 12. If the front and rear signals are both applied then the output is more constant and not subject to "fading" characteristics which are more disturbing at the low frequencies, since directionality is not as important in this range. Also, if both are applied, the buffer stage 63 prevents input signals from the mixed in/out port 64 in the third channel 16 from being mixed with the front and rear signals. On a separate combination, as described, a rear signal may, however, be brought from a chained module to be combined with a front signal to give a constant woofer operation a separate front or rear signal from the summing circuit 62 is coupled to the mixed in/out port 64 to be fed out of the module 10 to a coupled module as described hereafter in connection with later figures.

In the third channel 16, the electronic crossover 66 is a low pass filter circuit, again settable by a selector switch 68 at increments of 40, 80, 160 and 320 Hz with variable inbetween settings also being available. The low frequency signals passing the low pass crossover 66 are boosted in a pre-amp 69, following which signals can be passed directly to a level adjust circuit 70 before being directed to the output port 72. However, selectively actuable switches 74, 75, comprising single-pole double-throw elements or the like, can be utilized to transfer the signal through a 180° phase shifter 76. A sub-woofer speaker spaced at some distance from higher frequency speakers may result in acoustic wave energy that starts in phase reaching the listener's ear at different times. Introducing a 180° phase shift may compensate for this time differential. The second switch 75 is used to couple in a single octave 12 dB equalization boost circuit 78 which operates at 45 Hz. Also in series with the third channel is a stereo/mono switch 80 which can be placed in the mono position if only a single sub-woofer is to be driven or if mono output is preferable from the listener's standpoint.

Figure 4:
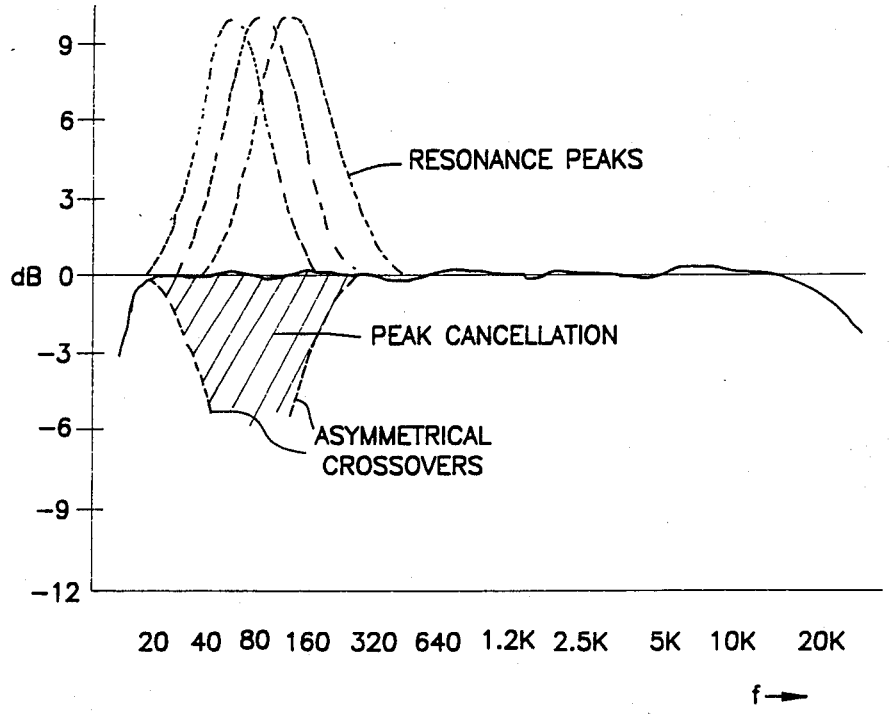
FIG. 4 is a graphical representation of frequency response characteristics versus frequency, useful in explaining adjustments made in systems in accordance with the invention.

With this configuration, the first channel 14 for the front speakers 24, 25 typically operated using the lower frequency high pass crossover circuit 40, and with the parallel input switch 60 off. The second channel 15 receives the rear signals and is set to provide high pass cutoff in the range of 40–320 Hz. The third channel receives front and rear signals summed together by the summing circuit 62 and fed through the buffer stage 63. The crossover circuits 40, 50 may be set at a single or different high pass crossover points spaced apart from the crossover point of the low pass crossover 66, to reduce or eliminate resonance at some intermediate frequency, say 150 Hz. As seen in FIG. 4, a simple or complex resonance may be introduced because of the close spacing and highly reflective surfaces in the vehicle. Spacing the cutoff points apart, as shown in FIG. 4, can be used to diminish the resonance and equalize frequency response.

Figure 2A:
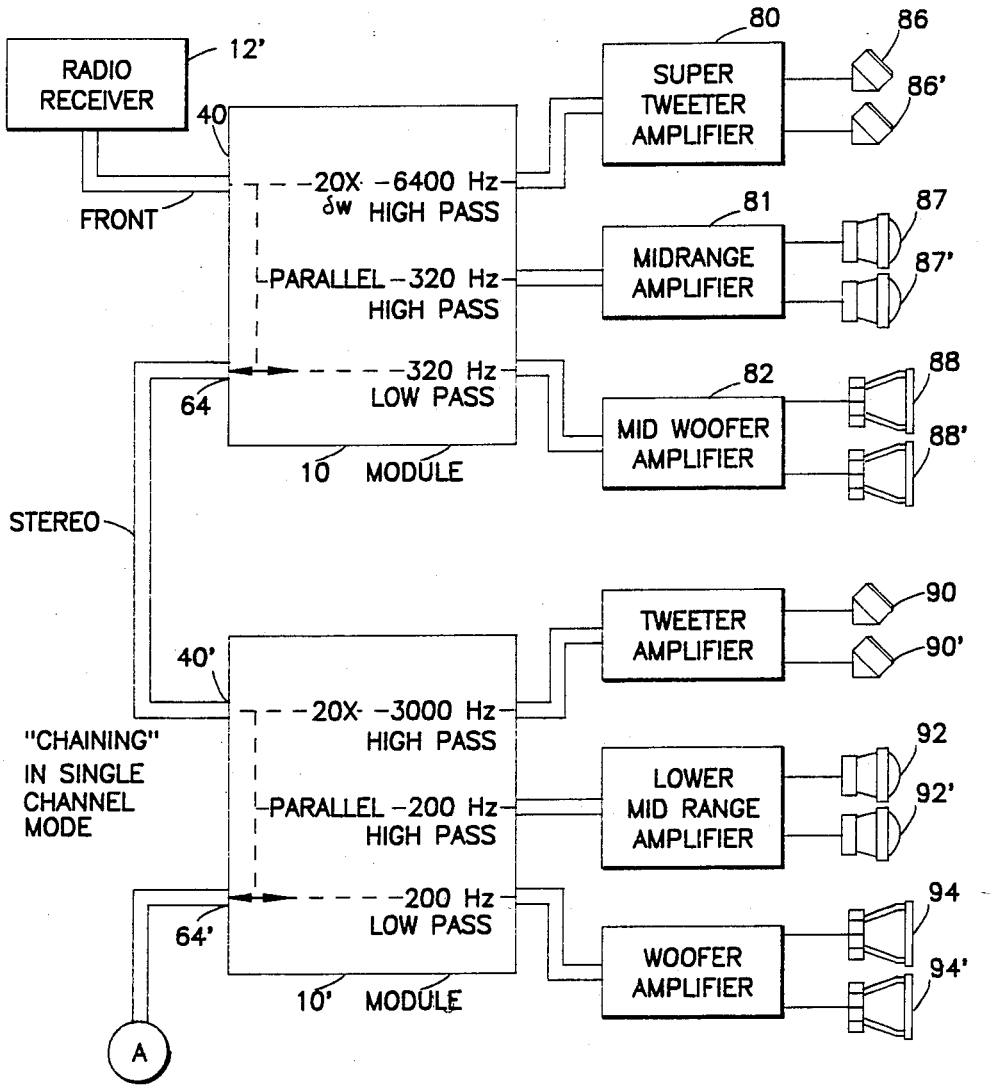
FIGS. 2*a* and 2*b* together form a block diagram representation of a different audio installation utilizing electronic crossover modules in accordance with the invention.
Figure 2B:
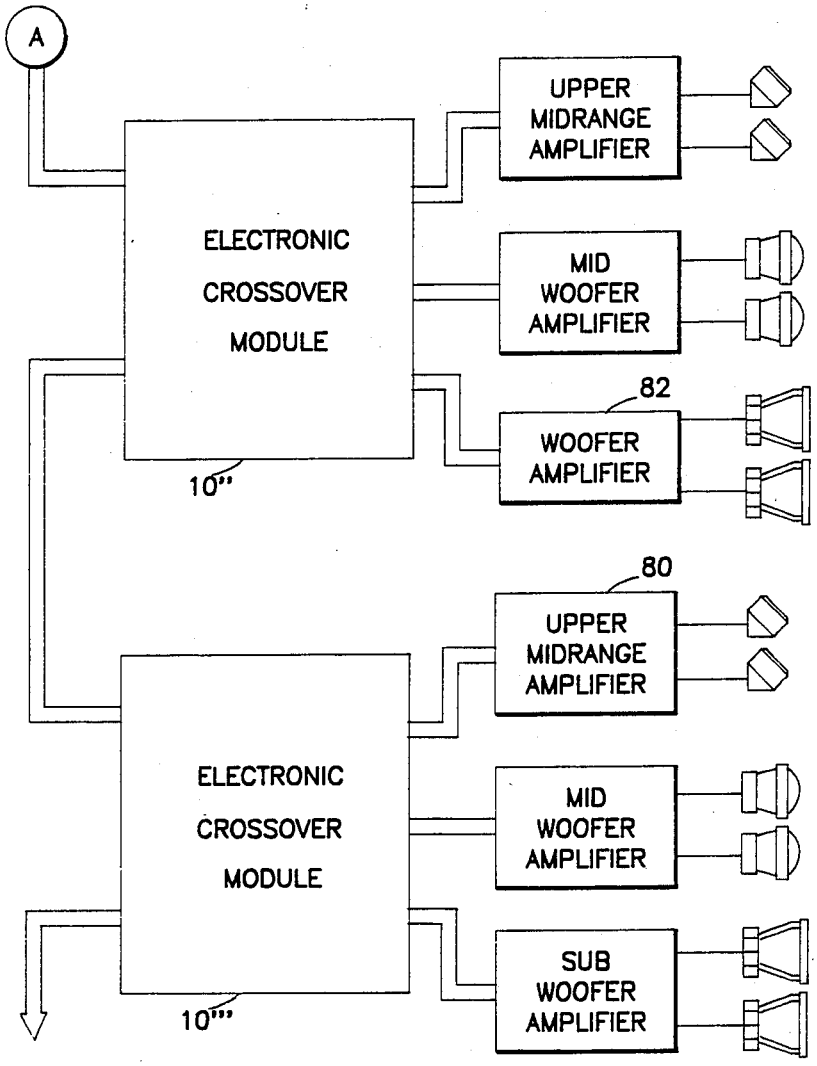

In a tri-amp configuration extended to many speakers, as seen in FIG. 2, the audio source 12' provides a single stereo (front) signal to the first module 10 in a parallely chained group of crossover modules 10', 10'', 10''', etc. By "parallel chairing" is meant that signal interconnections are serial but that within the modules there is parallelism as to crossover points. The 20 X switch 44 in each module is set to actuate the high pass crossover 41 (FIG. 1) having the higher frequency range. With the first channel 14 set to pass only a very high frequency range of 6400 Hz and above to a super tweeter amplifier 80, and the second channel 15 set to pass a midrange of 320 Hz and above to a midrange amplifier 81, the third channel 16 can drive a midwoofer amplifier 82 at 320 Hz and below. The different amplifiers 80, 81, 82 drive pairs of super tweeters 86, 86', midrange speakers 87, 87' and mid-woofers 88, 88' respectively.

At the next adjacent, parallel operated, module 10' the same input signals are applied but the settings in the three channels can be entirely different. Thus the first channel 14 may drive tweeters 90, 90' in the 3000 Hz and up range, the second channel 15 may drive lower midrange speakers 92, 92' in the 200 Hz and up range and the third channel may drive woofers 94, 94' in the range below 200 Hz. Spaced or overlapping cutoffs can be employed as described above in all instances. In the system of FIG. 2 the next adjacent module 10', is shown as controlling speakers for the upper midrange, mid-woofer and woofer ranges respectively while the next module 10''' drives upper midrange, mid-woofer, and sub-woofer speakers respectively. Although more modules can be added, this example shows four different tri-amp configurations with individual and independent settings for each.

Figure 3:
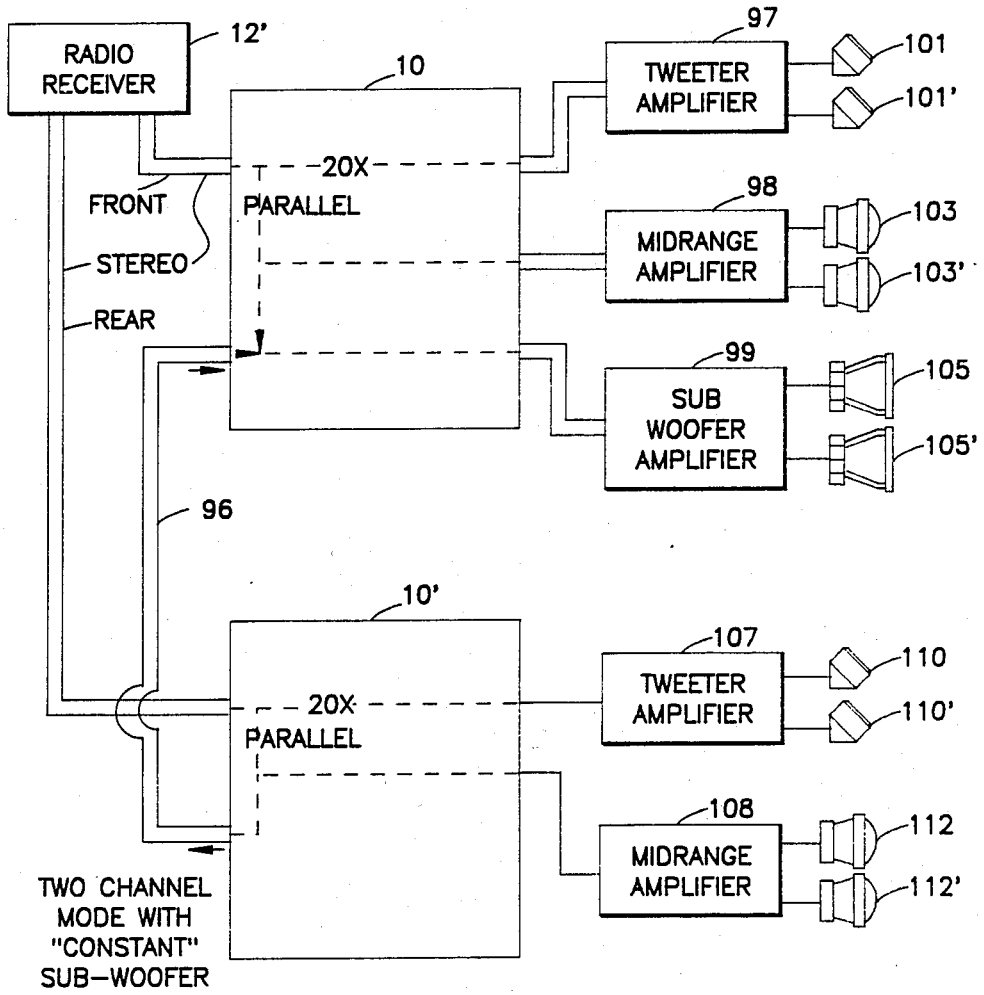
FIG. 3 is a block diagram representation of yet another audio installation using electronic crossover modules in accordance with the invention.

The system of FIG. 2 is a two-channel type of system in which there is only a front stereo input. In a number of modern systems there is four channel operation (separate front and rear signals) each in stereo, as seen in FIG. 3. Here the signal source 12'' provides a front output to the first channel 14 of a first module 10 while the rear output goes to the first channel 14 of a second module 10'. The mixed in/out ports 64 of the two modules 10, 10' are coupled together by a connector 96, so that both front and rear signals are summed together at the third channel 16 of the first module 10, to drive a single pair of sub-woofers. The third channel of the second module 10' is not otherwise used in this example, but obviously is available for separate use if desired.

At the first module 10 the first channel 14 drives a tweeter amplifier 97 and a pair of front tweeters 101, 101' at above a selected high range cutoff, while an intermediate range cutoff is used in the second channel 15 to drive a midrange amplifier 98 and a pair of front midrange speakers 103, 103'. The combined front and rear signals actuate a sub-woofer amplifier 99 to drive a single pair of sub-woofers 105, 105' for the entire system. At the second module 10' the settings in the first and second channels are for tweeter and midrange amplifiers 107, 108 respectively which drive associated rear tweeters 110, 110' and rear midrange speakers 112, 112' respectively.

In the example of FIG. 5 is depicted a multiple chain of crossover modules 10, 10', 10'', 10''', in which separate front and rear signals from a source 12, are used to provide constant sub-woofer outputs combining both front and rear sources. Any number of crossover modules can be chained together in like manner to an indefinite length if desired. The high pass amplifier/speaker channels have not been shown in detail since it is understood they may be as previously depicted. The front input is passed via the mixed in/out port 64 of first module 10 to the first channel input port 45 of the first channel of the second module 10'. Similarly, the rear signal from the source 12' activates the third and fourth modules 10'' and 10'''. Because the third channels of the second and fourth modules 10' and 10''' receives both the front and rear signals via the interconnection 120 between them (and the signal passed through from the prior module 10 or 10'), they provide "constant" sub-woofer signals for respective amplifiers 22', 22'' and sub-woofers 30', 31' and 30'', 31''. The third channels in the first and third modules need not drive any speakers or may, as shown, drive woofers using some high cutoff settings.

Thus intercoupling arrangements, speaker combinations, and crossover points can be varied to achieve a wide range of different effects, in accordance with the invention. It will be appreciated that the depicted forms and variations are merely illustrative, and that the scope of the invention is to be defined by the appended claims.

What is claimed is:

1. An electronic crossover system for use in a variety of multi-amplifier configurations receiving signals from an audio signal source, comprising:

means defining first, second and third signal channels, each having an input and an output;

first switch means for selectively coupling the inputs of the first and second channels in parallel;

means for summing the inputs of the first and second channels at the input of the third channel;

first adjustable high pass crossover means coupled in the first channel;

second adjustable high pass crossover means coupled in the second channel;

first adjustable low pass crossover means coupled in the third channel, wherein each of the crossover means is independently adjustable of the other; and selectively actuable high pass crossover means disposed in the first signal channel for providing an adjustable high pass crossover at a substantially higher frequency than the first high pass crossover means.

2. A system as set forth in claim 1 above, wherein the first adjustable high pass crossover means comprises first control means for adjusting the crossover point, and wherein the selectively actuable high pass crossover is controlled by the first control means and operates in response to the first control means to provide a multiple of the setting for the first high pass crossover means.

3. A system as set forth in claim 2 above, wherein the selectively actuable high pass crossover means operates at crossover points many times higher than the first high pass crossover means, and wherein the third channel further comprises selectively actuable means for shifting the phase of the signal thereby by 180°.

4. A system as set forth in claim 3 above, wherein high pass crossover points in the first and second high pass crossover means are selectable in the range at approximately 40 to 320 and wherein the third channel includes selectively actuable means for providing a single octave 12 dB boost at 45Hz in the third channel.

5. A system as set forth in claim 4 above, wherein all channels are stereo channels and the third channel comprises means for combining the signals therein in a mono output.

6. A system as set forth in claim 5 above, further including separate means in each of the different channels for adjusting the level of the signal therein, and wherein the crossover means are adjustable.

7. A system as set forth in claim 1 above, wherein the means defining the third signal channel comprises a mixed input/output means including port means for providing summed and buffered output signals from the inputs coupled from the means defining the first and second signal channels and input signals from signals applied to the port means.

8. A system as set forth in claim 7 above, wherein the mixed input/output means comprises summing circuit means and buffer means for isolating input signals applied from the first and second channels from the port means when input signals are applied thereto.

9. An electronic crossover module for versatile interconnection of input signal sources and separate amplifier/speaker sets comprising:

means in the crossover module for defining first, second and third signal channels having separately adjustable crossover points;

input signal interconnection means including first and second channel input port means and third channel input/output port means, and means for coupling the input of the first and second channels to the input of the third channel; and means for selectively coupling the input of the first signal channel to the input of the second signal channel, and wherein signal inputs at the first and second channels are concurrently providable as outputs at the third channel input/output port means and as inputs at the third channel, and alternatively combinable with inputs to the third channel input/output port means as signals for the third channel.

10. A versatile crossover interconnection and amplification system for vehicular audio systems to enable external resonances arising from the vehicle interior geometry to be compensated in achieving a flat system response, comprising:

first amplifier/speaker means providing at least one output in a first frequency range;

second amplifier/speaker means providing at least one output in a second frequency range lower than the first;

electronic crossover means receiving a first input audio signal and providing input signals to both amplifier/speaker means, the electronic crossover means comprising separate crossover means in different channels, one for each amplifier speaker means;

a summing circuit, the summing circuit transferring the first input audio signal to a buffer stage, the buffer stage having a first output, the first output transferring the first input audio signals to the electronic crossover means corresponding to the second amplifier/speaker means; and a mixed input or output port, the mixed input or output port being capable of receiving the first output from the buffer stage, the mixed input or output port being capable of transferring the first input audio signal to a device external to the crossover interconnection and amplification system.

11. The crossover interconnection and amplification system of claim 10, further comprising:

(a) third amplifier/speaker means providing at least one output in a third frequency range, the third amplifier/speaker means having an input signal comprising a second input audio signal; and (b) coupling means, the coupling means interconnecting the first input audio signal and the second input audio signal to the summing circuit, the summing circuit combining the first input audio signal and the second input audio signal so as to produce a single summed output signal, the singled summed output signal serving as the input to the buffer stage.

12. The crossover interconnection and amplification system of claim 11, further comprising a third input audio signal, the third input audio signal being connected to the mixed input or output port, thereby creating an audio input signal to the electronic crossover means corresponding to the second amplifier/speaker means comprising the single summed output signal and the third input audio signal.

13. The crossover interconnection and amplification system of claim 11 wherein the single summed output signal is simultaneously transferred to the input of an external electronic crossover module via the mixed input or output port.

14. The crossover interconnection and amplification system of claim 13 wherein the electronic crossover means corresponding to the second amplifier/speaker means operates as a low pass filter, thereby serving as a relatively constant output low frequency processing channel for any low frequency signals present in the first, second and third input audio signals.

15. The crossover interconnection and amplification system of claim 13, wherein the singled summed output signal may be successively transferred via the mixed input or output port to a substantially identical crossover interconnection and amplification system, thereby serving as an input and becoming a component of successive summed output signals.

16. A versatile crossover interconnection and amplification system for vehicular audio systems to enable external resonances arising from the vehicle interior geometry to be compensated in achieving a flat system response, comprising:

first amplifier/speaker means comprising a first tweeter channel and a second midrange channel each including separate selectively variable high pass filter means;

second amplifier/speaker means comprising a third woofer or subwoofer channel including selectively variable low pass filter means, electronic crossover means receiving an input audio signal and providing input signals to both amplifier/speaker means, the electronic crossover means comprising:

(a) separate crossover means in each of the three channels;

(b) controllable means intercoupling the inputs of the different channels for alternatively providing inputs or outputs at one of the channels such that the electronic crossover means can be interconnected serially with other electronic crossover means in other amplification systems to provide multiple crossovers;

(c) at least a first input for the first amplifier speaker means;

(d) input/output means for the second amplifier/-speaker means;

(e) selectable parallel coupling means between the separate channels;

(f) the crossover means in the first and second channels comprising individually adjustable high pass crossovers, the crossover means in the third channel comprising an individually adjustable low pass crossover;

(g) first switch means selectively intercoupling the first and second channels, circuit means coupling the first and second channels to the third channel, separate interconnection ports coupled to the inputs of the individual channels; and (h) means at the interconnection port for the third channel for (1) feeding signals out thereat from the first and second channels, and (2) alternatively combining inputs received thereat with signals from the first and second channels.

* * * * *